US008928571B2

(12) United States Patent
Chen et al.

(10) Patent No.: US 8,928,571 B2
(45) Date of Patent: Jan. 6, 2015

(54) DRIVING METHOD INCLUDING CHARGE SHARING AND RELATED LIQUID CRYSTAL DISPLAY DEVICE

(75) Inventors: Ji-Ting Chen, Hsinchu County (TW); Kuang-Feng Sung, Taichung County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 834 days.

(21) Appl. No.: 12/538,173

(22) Filed: Aug. 10, 2009

(65) Prior Publication Data

US 2010/0188374 A1 Jul. 29, 2010

(30) Foreign Application Priority Data

Jan. 23, 2009 (TW) ..... 98102925 A

(51) Int. Cl.
*G09G 3/36* (2006.01)

(52) U.S. Cl.
CPC ..... *G09G 3/3614* (2013.01); *G09G 3/3688* (2013.01); *G09G 2330/021* (2013.01)
USPC ..... 345/98; 345/96

(58) Field of Classification Search
CPC ..... G09G 3/3614; G09G 3/3659
USPC ..... 345/96, 98
See application file for complete search history.

(56) References Cited

U.S. PATENT DOCUMENTS 6,064,363 A * 5/2000 Kwon ..... 345/98
6,549,186 B1 * 4/2003 Kwon ..... 345/95
6,573,881 B1 * 6/2003 Kwon ..... 345/92
6,642,916 B1 * 11/2003 Kodama et al. ..... 345/100
6,784,866 B2 * 8/2004 Udo et al. ..... 345/100
7,911,437 B1 * 3/2011 Bell ..... 345/100
2004/0263466 A1 * 12/2004 Song et al. ..... 345/100
2005/0024547 A1 * 2/2005 Park ..... 349/39
2005/0219195 A1 * 10/2005 Yano et al. ..... 345/100
2006/0001630 A1 * 1/2006 Chen et al. ..... 345/96
2006/0022929 A1 * 2/2006 Hashimoto et al. ..... 345/96
2006/0044301 A1 * 3/2006 Ha ..... 345/209
2006/0092120 A1 * 5/2006 Nose ..... 345/98
2006/0097967 A1 * 5/2006 Lee ..... 345/87
2006/0119596 A1 * 6/2006 Lin ..... 345/211
2006/0164375 A1 * 7/2006 Kim et al. ..... 345/100
2006/0227092 A1 * 10/2006 Nose ..... 345/98
2006/0262069 A1 * 11/2006 Do et al. ..... 345/98
2006/0279514 A1 * 12/2006 Yokota et al. ..... 345/100
2007/0018923 A1 * 1/2007 Yokota ..... 345/89
2007/0200815 A1 * 8/2007 Yeh ..... 345/98

(Continued)

FOREIGN PATENT DOCUMENTS

CN 1728230 A 2/2006
CN 100377203 C 3/2008

(Continued)

*Primary Examiner* — Claire X Pappas
*Assistant Examiner* — Robert Stone
(74) *Attorney, Agent, or Firm* — Winston Hsu; Scott Margo

(57) ABSTRACT

A driving method for a Liquid Crystal Display (LCD) device is used for reducing power consumption of the LCD device. The driving method includes determining a driving approach of the LCD device, and performing corresponding charge sharing on a plurality of data channels according to the driving approach. The driving approach of the LCD device is determined according to a latch data (LD) signal and a polarity signal.

25 Claims, 14 Drawing Sheets

(56) References Cited

U.S. PATENT DOCUMENTS

| | | | | |
|---|---|---|---|---|
| 2007/0242019 | A1* | 10/2007 | Jung et al. | 345/98 |
| 2007/0296661 | A1* | 12/2007 | Ishiguchi | 345/87 |
| 2008/0136806 | A1 | 6/2008 | Lee | |
| 2008/0170057 | A1* | 7/2008 | Park et al. | 345/211 |
| 2009/0015297 | A1* | 1/2009 | Chen et al. | 327/108 |
| 2009/0153547 | A1* | 6/2009 | Chen et al. | 345/215 |
| 2010/0289791 | A1* | 11/2010 | Weng | 345/213 |
| 2011/0316901 | A1* | 12/2011 | Park et al. | 345/690 |
| 2012/0092322 | A1* | 4/2012 | Enjou et al. | 345/211 |
| 2012/0154358 | A1* | 6/2012 | Chen et al. | 345/209 |
| 2012/0218316 | A1* | 8/2012 | Wang et al. | 345/690 |

FOREIGN PATENT DOCUMENTS

| | | | |
|---|---|---|---|
| CN | 101135787 | A | 3/2008 |
| CN | 101226724 | A | 7/2008 |
| CN | 101334971 | A | 12/2008 |
| TW | 416239 | | 12/2000 |

* cited by examiner

DRIVING METHOD INCLUDING CHARGE SHARING AND RELATED LIQUID CRYSTAL DISPLAY DEVICE

BACKGROUND OF THE INVENTION

1. Field of the Invention

The present invention relates to a driving method for a liquid crystal display (LCD) device and a related device, and more particularly, to a driving method of performing corresponding charge sharing according to a driving approach of the LCD, and a related device.

2. Description of the Prior Art

The advantages of a liquid crystal display (LCD) include lighter weight, less electrical consumption, and less radiation contamination as compared to other conventional displays. Thus, LCD devices have been widely applied to various portable information products, such as notebooks, PDAs, etc. In an LCD device, incident light produces different polarization or refraction effects when the alignment of liquid crystal molecules is altered. The transmission of the incident light is affected by the liquid crystal molecules, and thus magnitude of the light emitting out of the liquid crystal molecules varies. The LCD device utilizes the characteristics of the liquid crystal molecules to control the corresponding light transmittance and produces gorgeous images according to different magnitudes of red, blue, and green light.

Please refer to FIG. 1, which illustrates a schematic diagram of a prior art thin film transistor (TFT) LCD device 10. The LCD device 10 includes an LCD panel 122, a timing controller 102, a source driver 104, and a gate driver 106. The LCD panel 122 is constructed by two parallel substrates, and the liquid crystal molecules are filled up between these two substrates. A plurality of data lines 110, a plurality of scan lines 112 that are perpendicular to the data lines 110, and a plurality of TFTs 114 are positioned on one of the substrates. There is a common electrode installed on another substrate for outputting a common voltage Vcom via the common electrode. Please note that only four TFTs 114 are shown in FIG. 1 for simplicity of illustration. In actuality, the LCD panel 100 has one TFT 114 installed in each intersection of the data lines 110 and scan lines 112. In other words, the TFTs 114 are arranged in a matrix format on the LCD panel 122. The data lines 110 correspond to different columns, and the scan lines 112 correspond to different rows. The LCD device 10 uses a specific column and a specific row to locate the associated TFT 114 that corresponds to a pixel. In addition, the two parallel substrates of the LCD panel 122 filled up with liquid crystal molecules can be considered as an equivalent capacitor 116.

The operation of the prior art LCD device 10 is described as follows. First, the timing controller 102 generates data signals for image display as well as control signals and timing signals for driving the control panel 122. The source driver 104 and the gate driver 106 generate input signals for different data lines 110 and scan lines 112 according to the signals sent by the timing controller 102 for turning on the corresponding TFTs 114 and changing the alignment of liquid crystal molecules and light transmittance, so that a voltage difference can be maintained by the equivalent capacitors 116 and image data 122 can be displayed in the LCD panel 100. For example, the gate driver 106 outputs a pulse to the scan line 112 for turning on the TFT 114. Therefore, the voltage of the input signal generated by the source driver 104 is inputted into the equivalent capacitor 116 through the data line 110 and the TFT 114. The voltage difference kept by the equivalent capacitor 116 can then adjust a corresponding gray level of the related pixel through affecting the related alignment of liquid crystal molecules positioned between the two parallel substrates. In addition, the source driver 104 generates the input signals, and magnitude of each input signal inputted to the data line 110 corresponds to different gray levels.

If the LCD device 10 continuously uses a positive voltage to drive the liquid crystal molecules, the liquid crystal molecules will not quickly change a corresponding alignment according to the applied voltages. Similarly, if the LCD device 10 continuously uses a negative voltage to drive the liquid crystal molecules, the liquid crystal molecules will not quickly change a corresponding alignment according to the applied voltages. Thus, the incident light will not produce accurate polarization or refraction, and the quality of images displayed on the LCD device 10 deteriorates. In order to protect the liquid crystal molecules from being irregular, the LCD device 10 must alternately use positive and negative voltages to drive the liquid crystal molecules. In addition, not only does the LCD panel 122 have the equivalent capacitors 116, but the related circuit will also have some parasitic capacitors owing to its intrinsic structure. When the same image is displayed on the LCD panel 100 for a long time, the parasite capacitors will be charged to generate a residual image effect. The residual image with regard to the parasitic capacitors will further distort the following images displayed on the same LCD panel 122. Therefore, the LCD device 10 must alternately use the positive and the negative voltages to drive the liquid crystal molecules for eliminating the undesired residual image effect, for example column inversion and dot inversion schemes are exploited.

Please refer to FIG. 2 and FIG. 3. FIG. 2 and FIG. 3 are schematic diagrams of a prior art column inversion driving approach. Blocks 20, 30 show polarities of pixels in the same part of two successive image frames. Comparing the blocks 20 and 30, when the LCD panel 122 is driven by the column inversion driving method, polarities of pixels in each column are identical and change to opposite polarities as a frame changes. Furthermore, polarities of pixels in two adjacent columns are opposite.

Apart from the driving approach mentioned above, the prior art can drive the LCD panel 122 in another way. Please refer to FIG. 4 and FIG. 5, which are schematic diagrams of a prior art dot inversion driving approach. Blocks 40, 50 show polarities of pixels in the same part of two successive image frames. Comparing the blocks 40 and 50, when the LCD panel 122 is driven by the dot inversion driving method, polarities of two adjacent pixels are opposite.

As mentioned above, when the driving voltages of the LCD panel 122 begin to reverse polarities, the LCD device 10 has the largest loading since the source driver 160 consumes the largest amount of current at this point in time. Generally, charge sharing is exploited to reuse electrical charges and reduce the reaction time that the equivalent capacitors 116 are charged to the expected voltage level. Further, power saving can be achieved. In the LCD device 10, the source driver 104 evenly allocates electrical charges by controlling transistor switches between two adjacent data lines to achieve charge sharing. Please refer to FIG. 6, which is a schematic diagram of voltage levels of an odd data channel and an even data channel next to the odd channel when an LCD is driven by the dot inversion driving approach according to the prior art. As shown in FIG. 6, the X-axis represents time and the Y-axis represents voltage level. The maximum and minimum driving voltage outputted to the equivalent capacitors 116 can be represented by VDD and VGND. The voltage level after charge sharing can be represented by Vavg. If the liquid crystal molecules are driven in the positive polarity, driving voltage Vp output to the equivalent capacitors 116 must be between the common voltage and the maximum driving voltage VDD. If the liquid crystal molecules are driven in the negative polarity, the driving voltage Vp output to the equivalent capacitors 116 must be between the minimum driving voltage VGND and the common voltage.

If the LCD panel 122 of the LCD device 10 is driven by the dot inversion driving approach, as shown in FIG. 6, when a driving period ends, the voltage level of the equivalent capacitor of an odd data channel CH_ODD is equal to the maximum driving voltage VDD, and the voltage level of the equivalent capacitor 116 of an even data channel CH_EVEN is equal to the minimum driving voltage VGND, assuming Vcom=0.5 VDD, and VGND=0. Before the next driving period starts, the LCD device 10 in the prior art first turns on transistor switches coupled to two adjacent data channels to perform charge sharing and neutralize electrical charges stored in liquid crystal capacitors in the end of the driving period. Thus, the voltage level of the equivalent capacitor of the odd data channel CH_ODD is pulled from Vp to Vavg. Similarly, the voltage level of the equivalent capacitor of the even data channel CH_EVEN is pulled from Vn to Vavg. Assuming Vp and Vn are equal to the maximum and minimum driving voltage, respectively, Vag=Vcom=0.5 VDD. During the next driving period, the polarity of the odd data channel CH_ODD turns from positive to negative. Since the source driver 102 discharges the odd data channel CH_ODD in advance through charge sharing, only a voltage difference ΔV=−0.5 VDD is provided for driving the liquid crystal molecules to control the gray levels of the relative pixels. Similarly, during the next driving period, the polarity of the even data channel CH_EVEN turns from negative to positive. Since the source driver 102 charges the even data channel CH_EVEN in advance through charge sharing, only a voltage difference ΔV=−0.5 VDD is provided for driving the liquid crystal molecules to control the gray levels of the relative pixels.

However, according to the prior art, the pixels in the same column and the same frame have identical polarities in the column inversion driving approach. Therefore, the performance of charge sharing discharges the electrical charges and turns polarity from positive to negative. Consequently, more power consumption will be caused if the polarity must remain positive. Please refer to FIG. 7, which is a schematic diagram of voltage levels of an odd data channel and an even data channel next to the odd channel when an LCD is driven by the column inversion driving approach according to the prior art. In FIG. 7, the X-axis represents time and the Y-axis represents voltage level. When a driving period ends, the voltage level of the equivalent capacitor of an odd data channel CH_ODD is equal to the maximum driving voltage VDD, and the voltage level of the equivalent capacitor of an even data channel CH_EVEN is equal to the minimum driving voltage VGND, assuming Vcom=0.5 VDD, and VGND=0. Before the next driving period starts, the LCD device 10 in the prior art first turns on transistor switches coupled to two adjacent data channels to perform charge sharing and neutralize electrical charges stored in liquid crystal capacitors in the end of the driving period. Thus, the voltage level of the equivalent capacitor in the odd data channel CH_ODD is pulled from Vp to Vavg. Similarly, the voltage level of the equivalent capacitor in the even data channel CH_EVEN is pulled from Vn to Vavg. In this situation, if the odd data channel CH_ODD intends to stay positive and the even data channel CH_EVEN intends to stay negative in the next driving period, the source driver 104 must provide an extra-absolute voltage difference |ΔV|=0.5 VDD| for the displaying unit. In other words, charge sharing does not save power, but causes even greater power consumption.

As shown above, charge sharing cannot be adapted to all kinds of driving approaches according to the prior art; for example, in column inversion driving approach, extra power consumption may be caused.

SUMMARY OF THE INVENTION

It is therefore an objective to provide a driving method for a liquid crystal display device and related device.

The present invention discloses a driving method for a liquid crystal display (LCD) device. The driving method comprises determining a driving approach of the LCD device and performing corresponding charge sharing on a plurality of data channels according to the driving approach of the LCD device.

The present invention further discloses a driving device applied to an LCD device. The driving device comprises a determining unit and a control unit. The determining unit is used for determining a driving approach of the LCD device. The control unit is used for performing corresponding charge sharing on a plurality of data channels according to the driving approach of the LCD device.

The present invention further discloses a liquid crystal display (LCD) device. The LCD device comprises a display panel, a timing controller, a charge sharing module, and a source driver. The timing controller is used for outputting an LD signal and a polarity signal. The charge sharing module is coupled to the timing controller and used for detecting a driving approach of the LCD to output a control signal according to the LD signal and the polarity signal. The source driver is coupled to the display panel and the charge sharing module and used for outputting image data to the display panel and adjusting a coupling relationship among a plurality of data channels to correct charge sharing performed on the plurality of data channels according to the control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
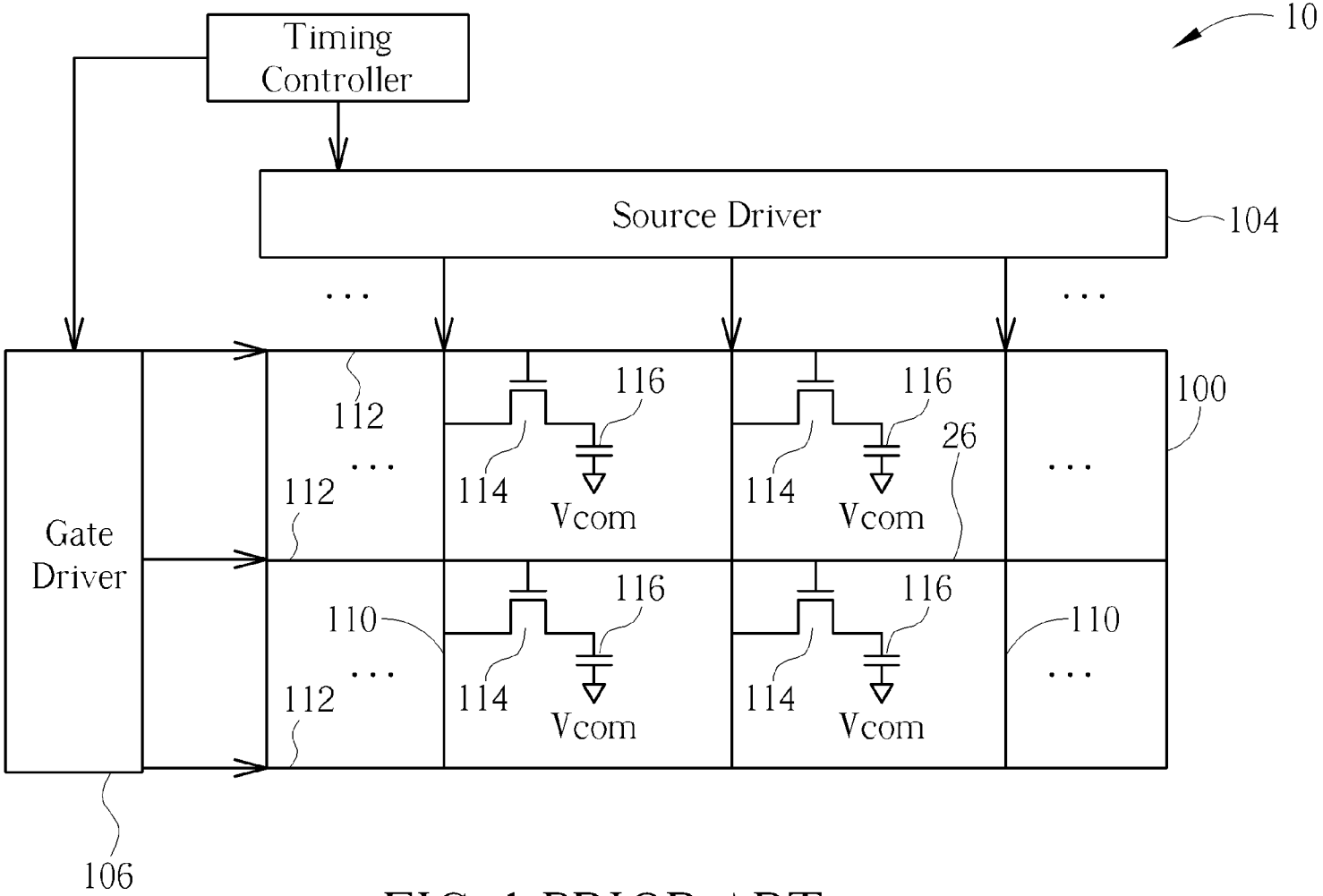
FIG. 1 PRIOR ART
FIG. 1 is a schematic diagram of a liquid crystal display (LCD) device according to the prior art.
Figure 2:
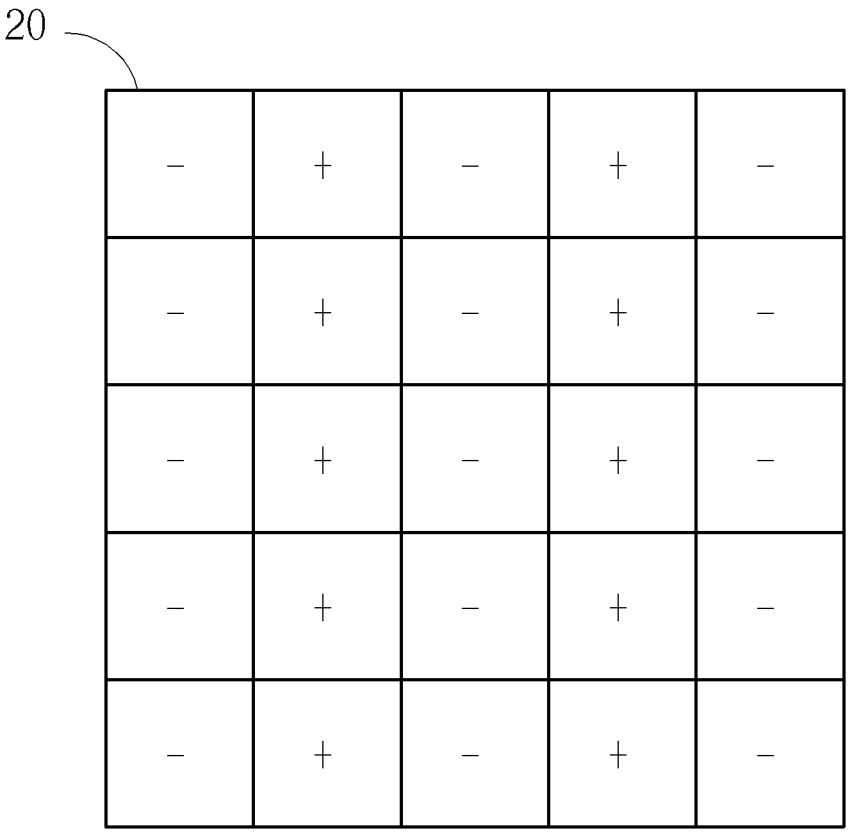
FIG. 2 PRIOR ART
FIGS. 2 and 3 are schematic diagrams of a column inversion driving approach according to the prior art.
Figure 3:
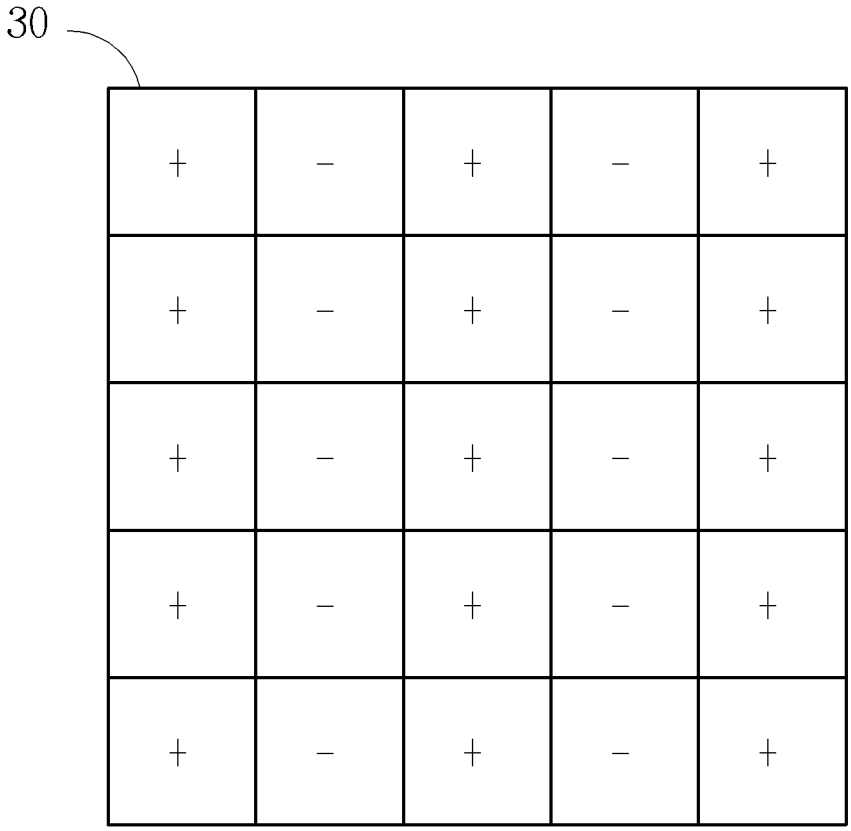
FIG. 3 PRIOR ART
Figure 4:
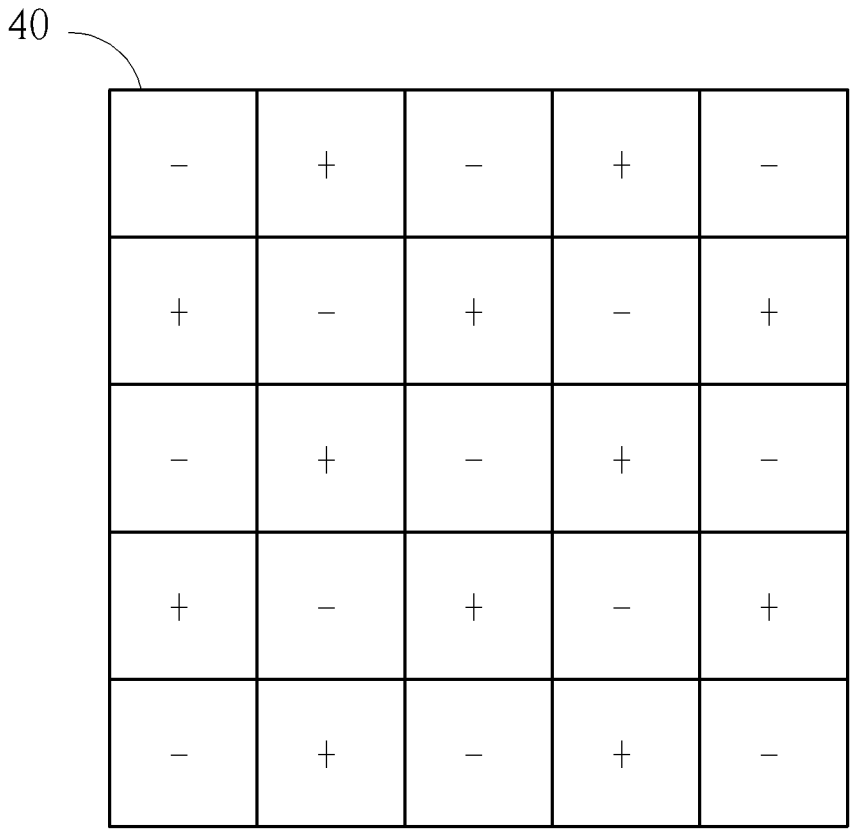
FIG. 4 PRIOR ART
FIGS. 4 and 5 are schematic diagrams of a dot inversion driving approach according to the prior art.
Figure 5:
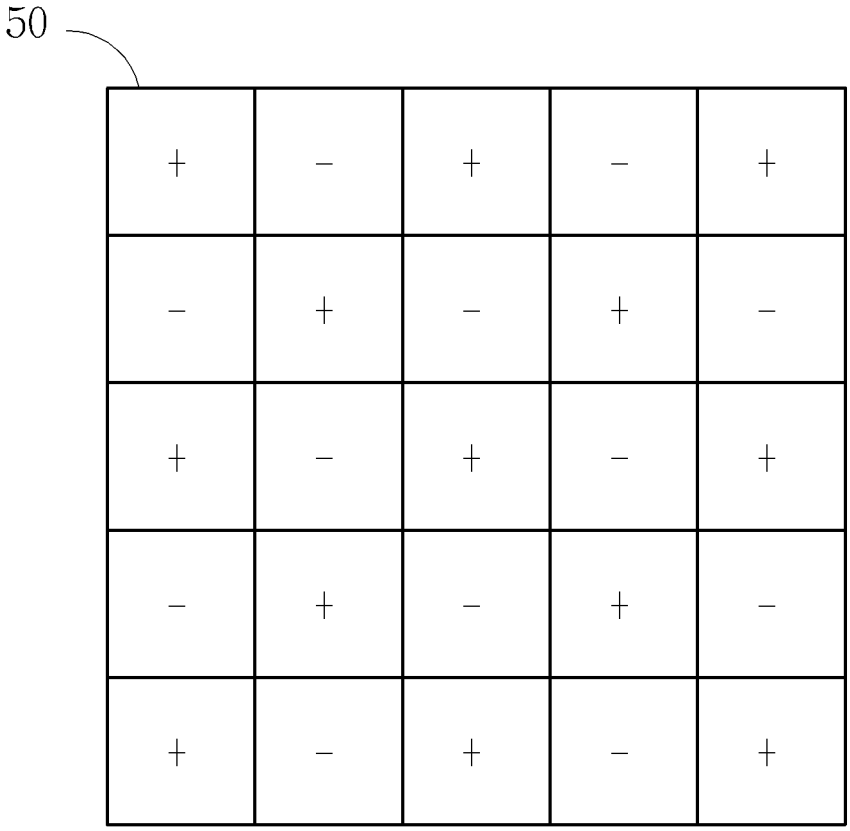
FIG. 5 PRIOR ART
Figure 6:
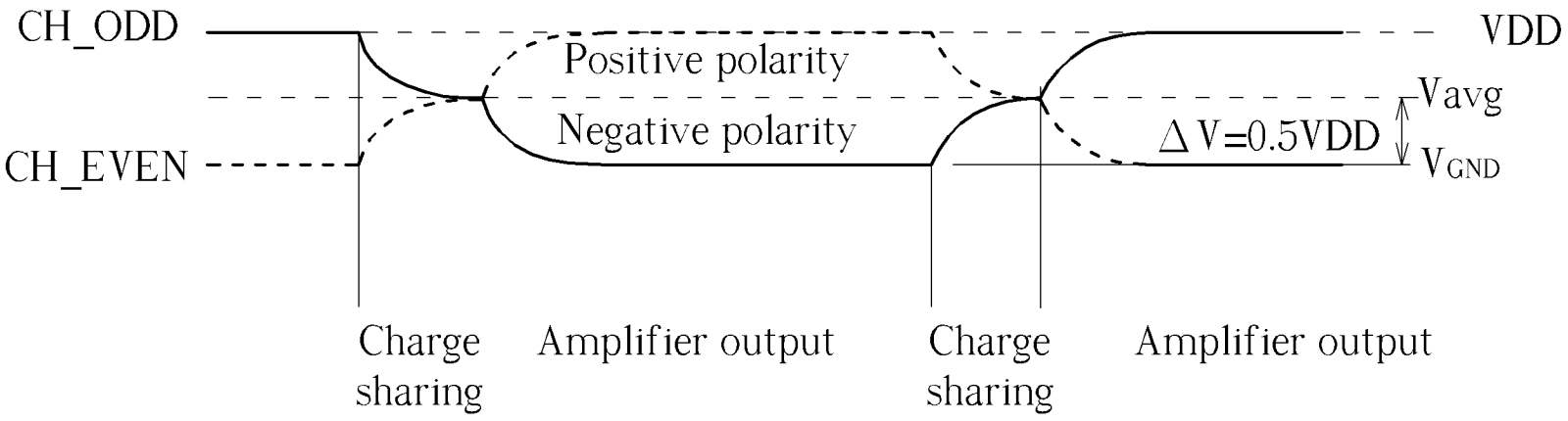
FIG. 6 PRIOR ART
FIG. 6 is a schematic diagram of voltage levels of an odd data channel and an even data channel next to the odd data channel when an LCD is driven by a dot inversion driving approach according to the prior art.
Figure 7:
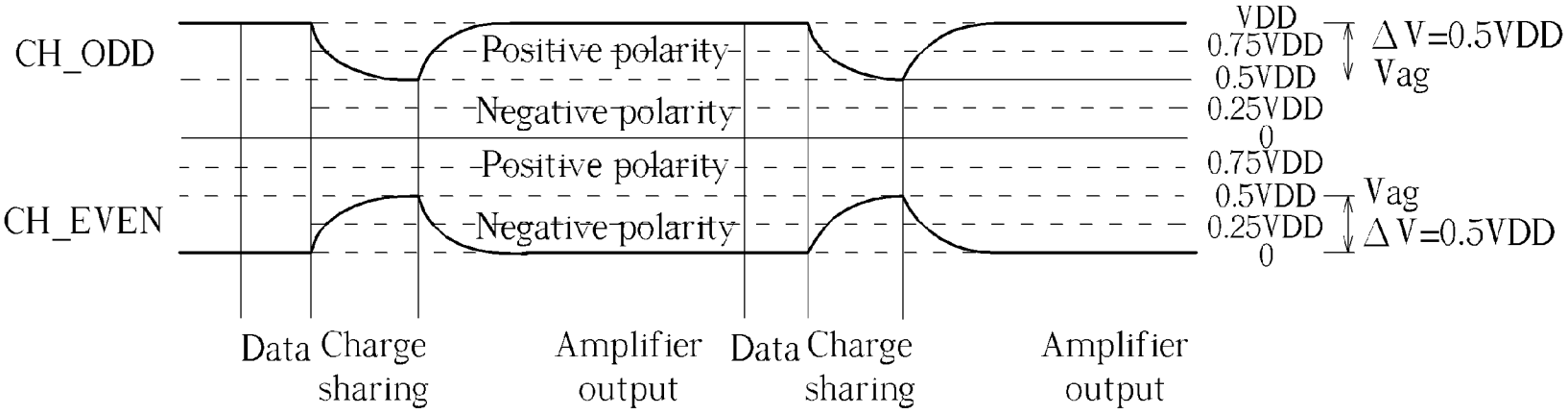
FIG. 7 PRIOR ART
FIG. 7 is a schematic diagram of voltage levels of an odd data channel and an even data next to the odd data channel when an LCD is driven by a column inversion driving approach according to the prior art.
Figure 8:
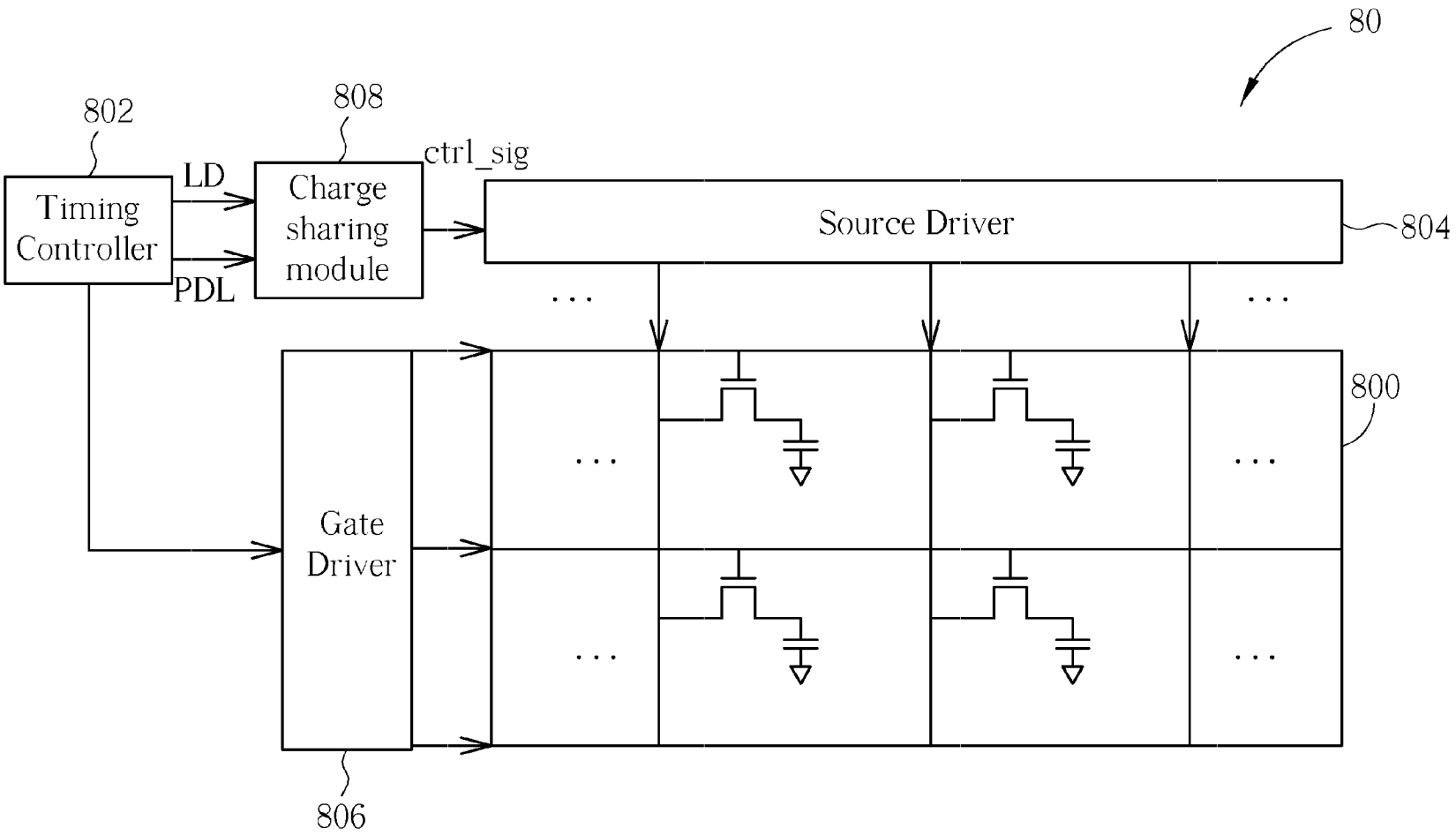
FIG. 8 is a schematic diagram of an LCD device according to an embodiment of the present invention.
Figure 9:
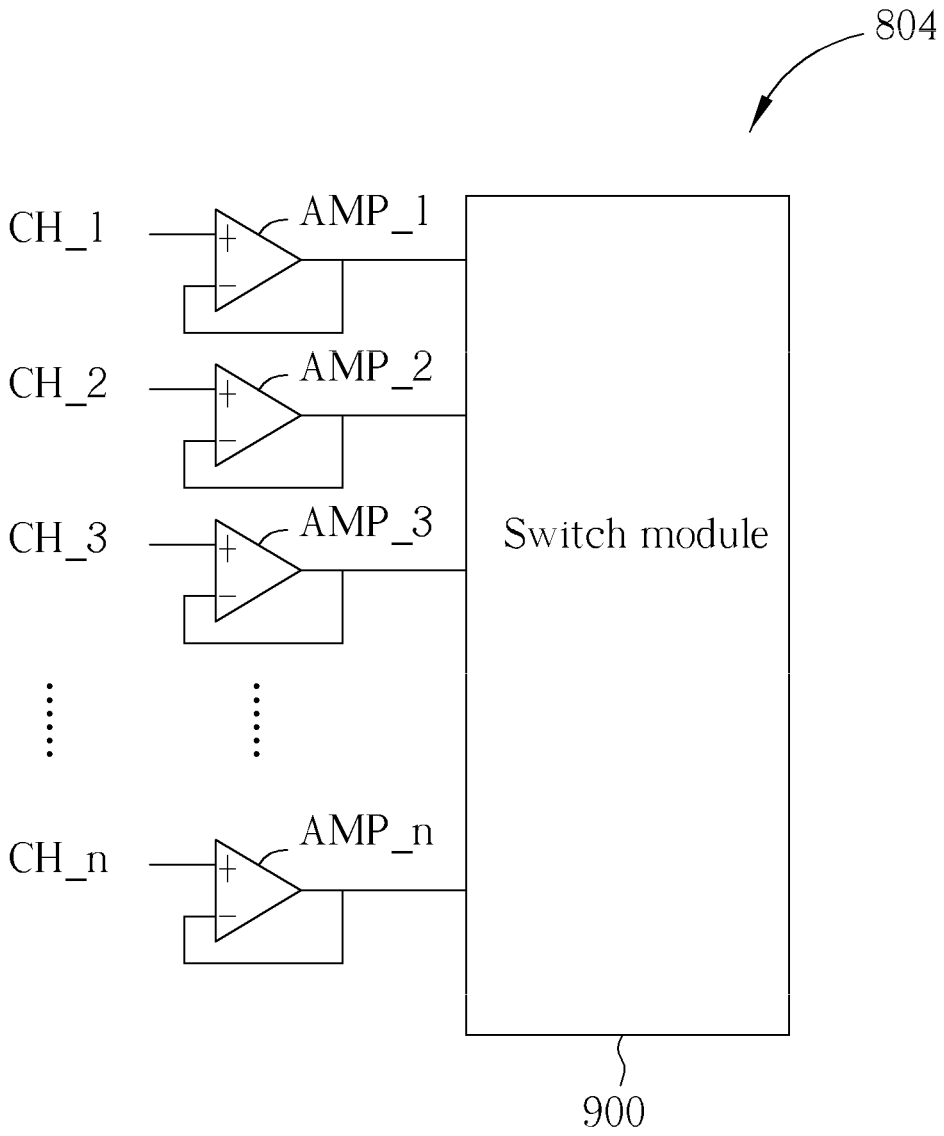
FIG. 9 is a schematic diagram of a source driver according to an embodiment of the present invention.

Please refer to FIG. 8, which is a schematic diagram of an LCD device 80 according to an embodiment of the present invention. The LCD device 80 may be driven by a dot inversion driving approach or a column inversion driving approach. The LCD device 80 includes a display panel 800, a timing controller 802, a source driver 804, a gate driver 806, and a charge sharing module 808. The structure of the LCD device 80 is similar to the LCD device 10 and thus identical parts thereof are not elaborated on herein. The difference is that the charge sharing module 808 can determine a driving approach of the LCD device to perform charge sharing accordingly, and further reduce power consumption by reusing electrical charges. To realize the operations mentioned above, as shown in FIG. 9, the source driver 804 includes a plurality of amplifiers AMP_1~AMP_n and a switch module 900. The amplifiers AMP_1~AMP_n are exploited to transmit driving signals toward corresponding data lines with respect to data channels CH_1~CH_n, to display different grey levels. The switch module 900 is coupled to the amplifier AMP_1~AMP_n, and used for performing charge sharing according to a control signal ctrl_sig generated by the charge sharing module 808.

Figure 10:
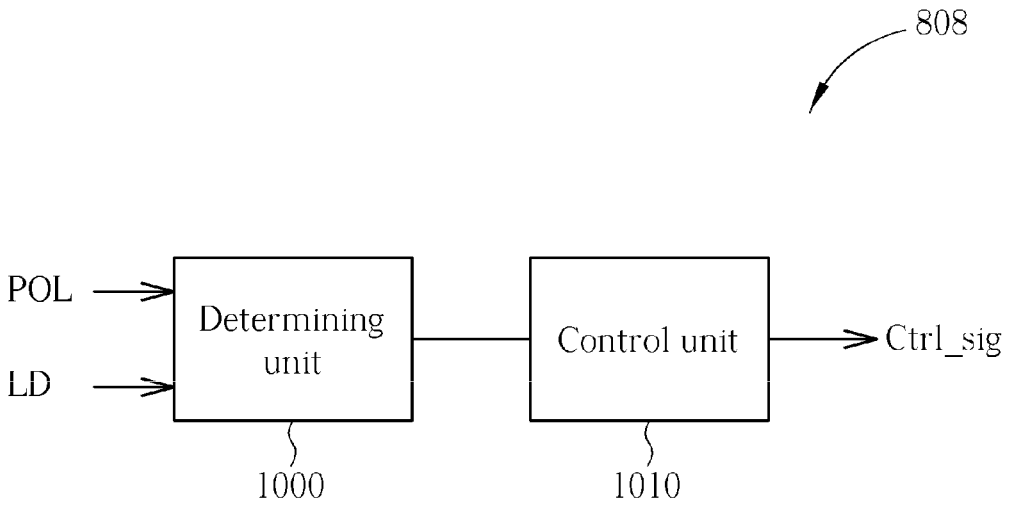
FIG. 10 is a schematic diagram of a charge sharing module according to an embodiment of the present invention.

In FIG. 8, the charge sharing module 808 is exploited to determine a driving approach before driving voltages are output to the LCD panel 800 for performing charge sharing correspondingly. The charge sharing module 808 further reduces the rising time for the equivalent capacitors of the LCD device 80 to be charged to expected voltage levels such that power consumption can be reduced. Please refer to FIG. 10, which is a diagram of the charge sharing module 808 shown in FIG. 8. The charge sharing module 808 includes a determining unit 1000 and a control unit 1010. The determining unit 1000 is used for determining a driving approach of the LCD device 80 according to a latch data (LD) signal and a polarity signal (POL) generated by the timing controller 802. The polarity signal is used for indicating the polarities of the liquid crystal molecules. The LD signal is used for representing initial signals of the amplifiers AMP_1~AMP_n. Thus, when the LD signal is trigged (high voltage level), the determining unit 1000 compares the polarities of the polarity signal corresponding to two adjacent high voltage levels of the LD signal to determine a driving approach of the LCD device 80. For example, when the polarities of the polarity signal are the same, the determining unit 1000 determines the driving approach of the LCD is the column inversion driving approach. When the polarities of the polarity signal are different, the determining unit 1000 determines the driving approach of the LCD is the dot inversion driving approach. According to a determining result of the determining unit 1000, the control unit 1010 transmits the control signal ctrl_sig to the switch module 900 for correspondingly performing charge sharing with respect to the data channels CH_1~CH_n.

Thus, through the charge sharing module 808, when the polarities of the polarity signal corresponding to two adjacent high voltage levels of the LD signal are the same, the driving approach of the LCD device 80 is determined to be the column inversion driving approach. Then, the present invention individually performs charge sharing on at least two adjacent odd data channels (CH_1, CH_3, CH_5, . . . ) and at least two adjacent even data channels (CH_2, CH_4, CH_6, . . . ). When the polarities of the polarity signal corresponding to two adjacent high voltage levels of the LD signal are different, the driving approach of the LCD device 80 is determined to be the dot inversion driving approach. Then, the present invention performs charge sharing on at least two adjacent data channels CH_1~CH_n. Consequently, the control unit 1010 performs charge sharing on the data channels CH_1~CHn accordingly.

Figure 11:
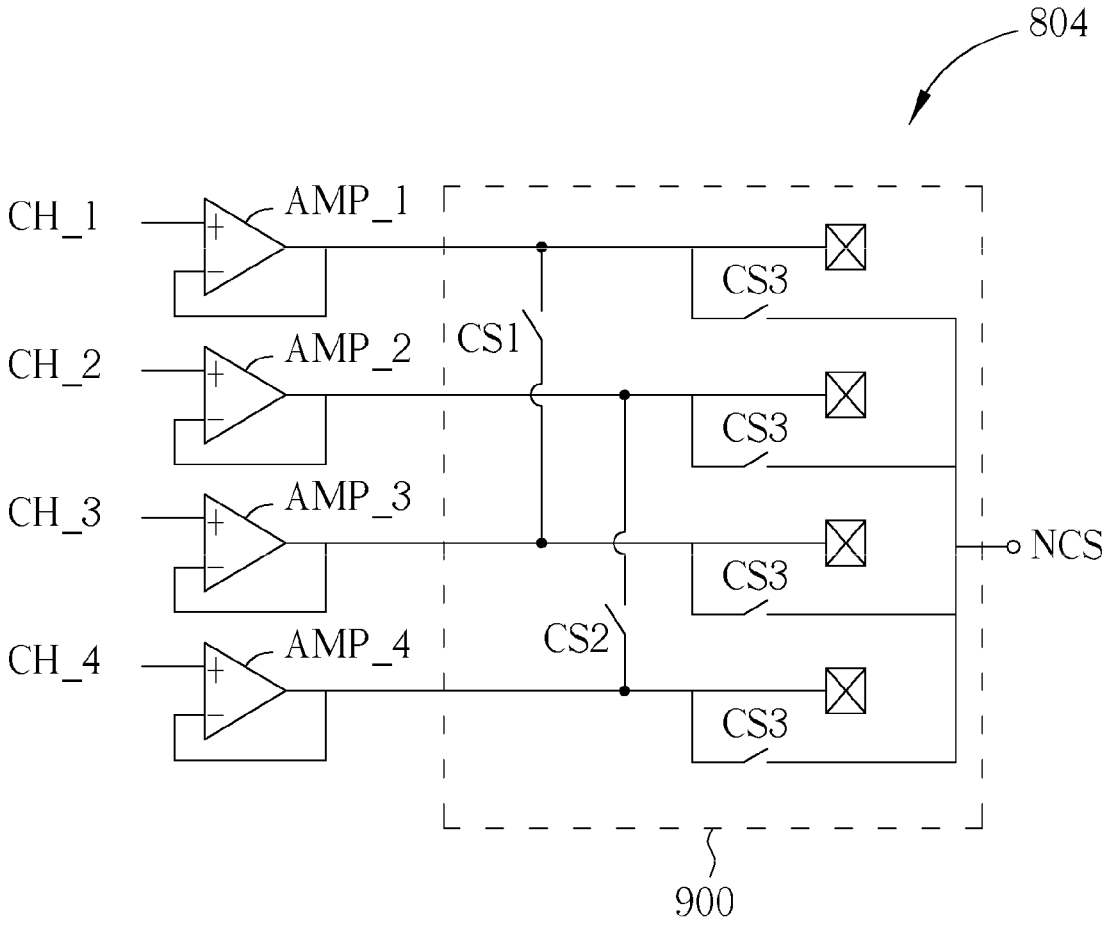
FIGS. 11 and 12 are schematic diagrams of source drivers according to different embodiments of the present invention.

Please note that the implementation of the source driver 804 is not limited to a specific structure. Any structure matching the operations of the charge sharing module 808 can be exploited. For example, please refer to FIGS. 11 and 12, which are schematic diagrams of the source driver 804 according to different embodiments of the present invention. In FIG. 11, the source driver 804 includes a switch module 900 and a plurality of amplifiers AMP_1~AMP_n. The switch module 900 is coupled to the data channels CH_1~CH_n. For simplicity, only the four data channels are illustrated herein. The switch module 900 includes a plurality of first charge sharing switches CS1*s*, second charge sharing switches CS2*s* and third charge sharing switches CS3. As shown in FIG. 11, each of the first charge sharing switches CS1*s* individually is coupled between two adjacent odd data channels (CH_1 and CH_3, CH_3 and CH_5, . . . ) of the data channels CH_1~CH_n, each of the second charge sharing switches CS2*s* individually is coupled between two adjacent even data channels (CH_2 and CH_4, CH_4 and CH_6, . . . ) of the data channels CH_1~CH_n and each of the third charge sharing switches CS3*s* individually is coupled between a node NCS and each of the data channels CH_1~CH_n.

Therefore, when the polarities of the polarity signal are the same (i.e. column inversion driving approach), the switch module 900 turns on the first charge sharing switches CS1*s* and the second charge sharing switches CS2*s*, and turns off the third charge sharing switches CS3*s* according to the control signal ctrl_sig for performing charge sharing on the adjacent odd data channels (CH_1, CH_3, . . . ) and the adjacent even data channels (CH_2, CH_4, . . . ) of the LCD device 808. When the polarities of the polarity signals are different (i.e. dot inversion driving approach), the switches module 900 turns on the first charge sharing switches CS1*s*, the second charge sharing switches CS2*s*, and the third charge sharing switches CS3*s* according to the control signal ctrl_sig for performing charge sharing on the adjacent data channels CH_1~CH_n.

Figure 12:
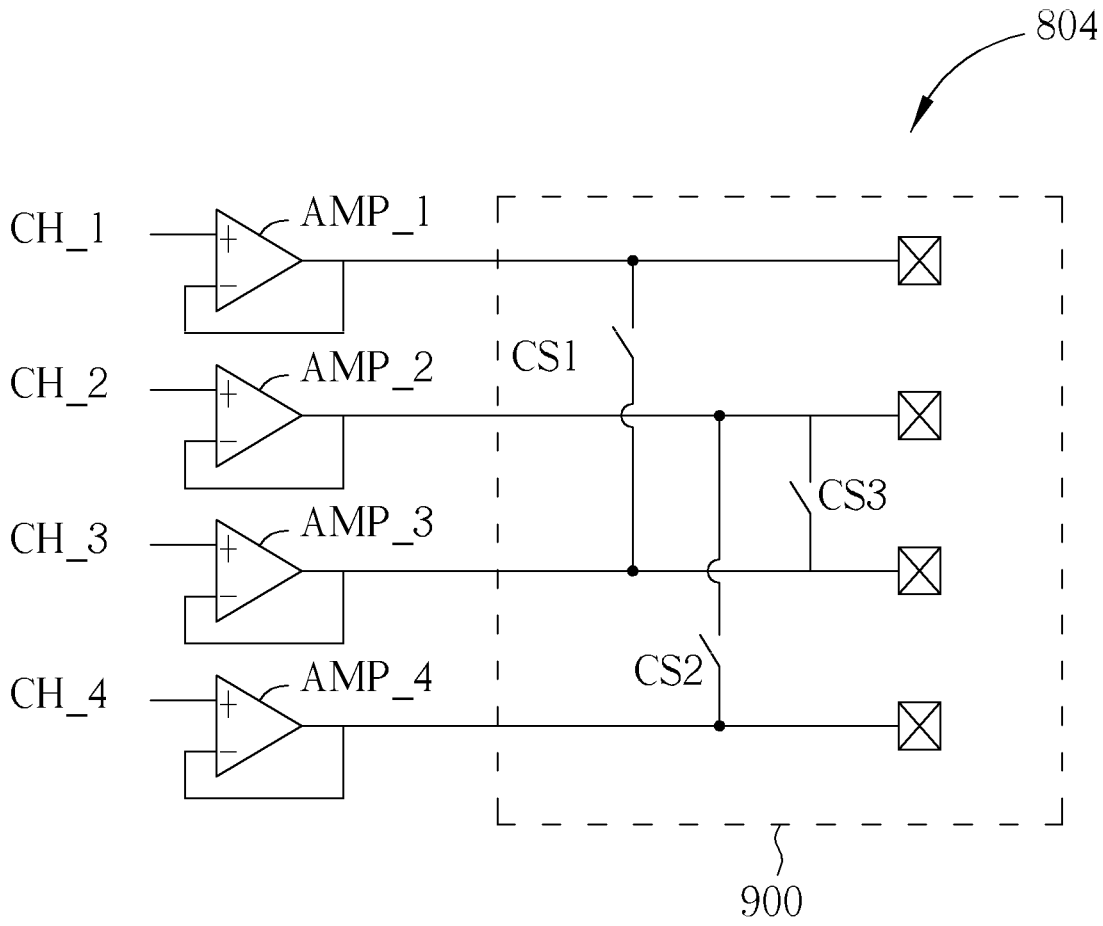

Similarly, the structure of the source driver 804 shown in FIG. 12 is similar to the one shown in FIG. 11, and identical parts thereof are not elaborated on herein. Additionally, the identical parts use the same symbols and the same titles. The difference between FIG. 12 and FIG. 11 is the coupling position of the charge sharing module 808. In FIG. 12, each of the first charge sharing switches CS1*s* is individually coupled between two adjacent odd data channels (e.g. CH_1 and CH_3, CH_3 and CH_5, . . . ), each of the second charge sharing switches CS2*s* is individually coupled between two adjacent even data channels (e.g. CH_2 and CH_4, CH_2 and CH_6, . . . ) and each of the third charge sharing switches CS3*s* is individually coupled between one of the even data channels and one odd data channel next to the even data channel (e.g. CH_2 and CH_3, CH_4 and CH_5, . . . ). In addiction, the operations of the charge sharing module can be known by referring to the above description. Namely, when the LCD device 80 is driven by the column inversion driving approach, the first charge sharing switches CS1*s* and the second charge sharing switches CS2*s* are turned on, and the third charge sharing switches CS3*s* are turned off. When the LCD device 80 is driven by the dot inversion driving approach, the first charge sharing switches CS1*s*, the second charge sharing switches CS2*s* and the third charge sharing switches CS3*s* are turned off. Therefore, the control unit 1010 perform charge sharing on each of the data channels CH_1~CH_n correspondingly by controlling the switch module 900.

Figure 13:
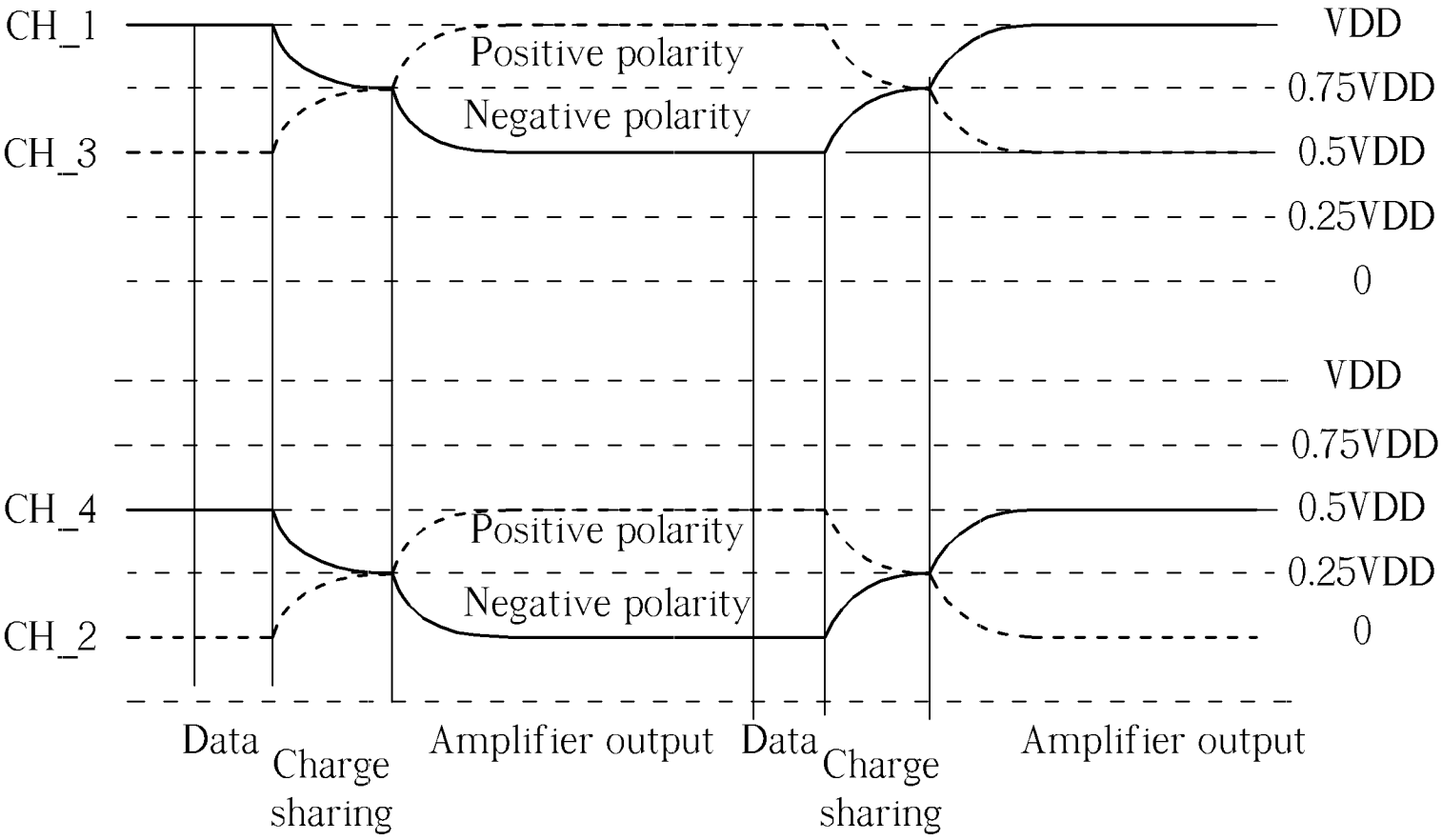
FIG. 13 is a schematic diagram of voltage levels of data channels CH_1~CH_4 when an LCD is driven by a column inversion driving approach according to an embodiment of the present invention.

Please refer to FIG. 13, which is a schematic diagram of voltage levels of data channels CH_1~CH_4 when an LCD is driven by a column inversion driving approach according to an embodiment of the present invention. In FIG. 13, the X-axis represents time, and the Y-axis represents voltage level. The maximum and minimum driving voltages output to the equivalent capacitors are represented by VDD and VGND, respectively. There are only four channels illustrated herein. At the end of a positive driving period, the voltage level of the equivalent capacitor of the data channel CH_1 is equal to the maximum driving voltage VDD, and at the end of a negative driving period, the voltage level of the equivalent capacitor of the data channel CH_3 is a little higher than half the maximum driving voltage VDD. The voltage level of the equivalent of the data channel CH_2 is equal to the minimum driving voltage VGND at the end of a negative driving period, and the voltage level of the equivalent capacitor of the data channel CH_4 is a little less than half the maximum driving voltage VDD at the end of a positive driving period. When the next driving starts, the voltage levels of the equivalent capacitors of the data channels CH_1 and CH_3 approximate to 0.75 VDD and the voltage levels of the equivalent capacitors of the data channels CH_2 and CH_4 approximate to 0.25 VDD since the electrical charges are re-allocated. Thus, during the next driving period, if the data channels CH_1, CH_2, CH_3, and CH_4 intend to maintain their original voltage levels, the source driver 804 provides an absolute voltage difference $|\Delta V|=0.25$ VDD only for displaying unit. To put it simply, in the column inversion driving approach, the present invention reduces extra power consumption from 0.5 VDD in the prior art to 0.25 VDD, and has a better performance on power saving.

Figure 14:
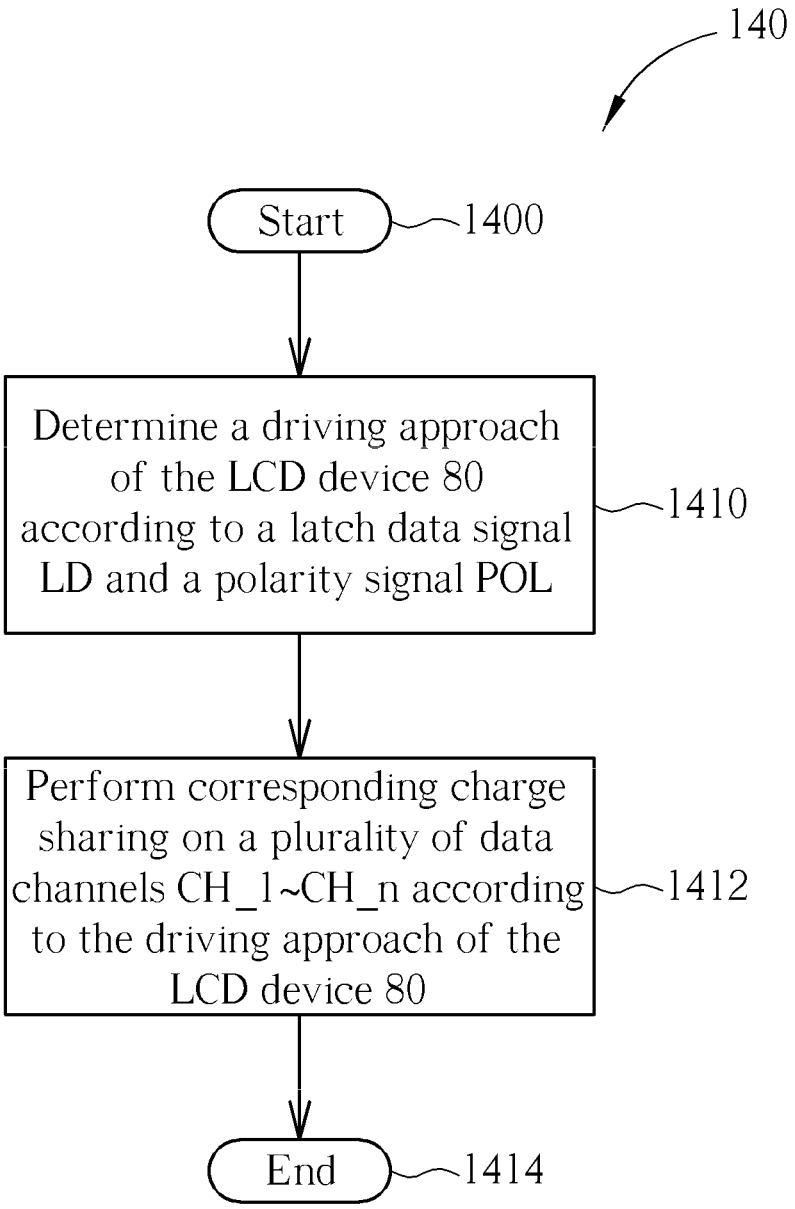
FIG. 14 is a flowchart according to an embodiment of the present invention.

The operations of the charge sharing module 808 can be summarized in a process 140 as shown in FIG. 14. The process 140 includes the following steps:

Step 1400: Start.

Step 1410: Determine a driving approach of the LCD device 80 according to a latch data signal LD and a polarity signal POL.

Step 1412: Perform corresponding charge sharing on a plurality of data channels CH_1~CH_n according to the driving approach of the LCD device 80.

Step 1414: End.

The process 140 is used for describing the operations of the charge sharing module 808. Detailed description can be found above, and thus is not elaborated on herein.

To put it simply, according to an embodiment of the present invention, the charge sharing module 808 first determines a driving approach of the LCD device 80, and performs charge sharing correspondingly. Consequently, even though the LCD device 80 takes advantage of the column inversion driving approach, the present invention can still save power.

To conclude, the present invention provides a driving method for an LCD device to determine a driving approach of the LCD device through a charge sharing module, and further perform corresponding charge sharing, which reuses electrical charges to reduce extra power consumption for a specific driving approach (e.g. column inversion driving approach) and achieves power saving.

Those skilled in the art will readily observe that numerous modifications and alterations of the device and method may be made while retaining the teachings of the invention.

What is claimed is:

1. A driving method for a liquid crystal display (LCD) device, the method comprising:

determining an inversion type of a driving approach; and performing charge sharing on different groups of data channels according to the different inversion types of driving approaches of the LCD device;

wherein at least a group of data channels are coupled to perform charge sharing during at least a partial time of a first inversion type of driving approach of the LCD device, wherein the group of data channels comprise at least a first data channel and a second data channel, and the first and second data channels are not coupled at all during a second inversion type of driving approach of the LCD device, or the first data channel is coupled to one or more third data channels during at least a partial time of the second inversion type of driving approach of the LCD device, wherein at least one of the one or more third data channels is different from the second data channel;

wherein the step of performing charge sharing on different groups of data channels according to the different inversion types of driving approaches of the LCD device comprises:

individually coupling each of a plurality of first charge sharing switches between two adjacent odd data channels of the plurality of data channels;

individually coupling each of a plurality of second charge sharing switches between two adjacent even data channels of the plurality of data channels; and individually coupling each of a plurality of third charge sharing switches between a node and each of the plurality of data channels;

turning on the plurality of first charge sharing switches and second charge sharing switches and turns off the plurality of third charge sharing switches, to perform a first charge sharing on the adjacent odd data channels and the adjacent even data channels of the LCD device when the driving approach is a column inversion driving approach.

2. The driving method of claim 1, wherein the step of determining the inversion type of the driving approach of the LCD device comprises:

determining the inversion type of the driving approach of the LCD device according to a latch data (LD) signal and a polarity signal.

3. The driving method of claim 2, wherein determining the inversion type of the driving approach of the LCD device comprises:

comparing polarities of the polarity signal corresponding to two adjacent high voltage levels of the LD signal, wherein when the polarities of the polarity signal are the same, the inversion type of the driving approach of the LCD is determined to be the column inversion driving approach.

4. The driving method of claim 3, wherein performing charge sharing on the different groups of data channels according to the different inversion types of driving approaches of the LCD device comprises:

performing a first charge sharing on at least two adjacent odd data channels of the LCD device and at least two adjacent even data channels of the LCD device individually when the driving approach is the column inversion driving approach.

5. The driving method of claim 2, wherein the step of determining the inversion type of the driving approach of the LCD device comprises:

comparing polarities of the polarity signal corresponding to two adjacent high voltage levels of the LD signal, wherein when the polarities of the polarity signal are different, the driving approach of the LCD is determined to be the dot inversion driving approach.

6. The driving method of claim 5, wherein the step of performing sharing on the different groups of data channels according to the driving approach of the LCD device comprises:

performing a second charge sharing on at least two adjacent data channels of the LCD device when the driving approach is the dot inversion driving approach.

7. The method of claim 1, wherein the driving approaches comprise the column inversion driving approach and a dot inversion driving approach.

8. A driving device applied to an LCD device, the driving device comprising:

a determining unit for determining an inversion type of a driving approach of the LCD device; and a control unit for performing charge sharing on different groups of data channels according to different inversion types of driving approaches of the LCD device;

wherein at least a group of data channels are coupled to perform charge sharing during at least a partial time of a first inversion type of driving approach of the LCD device, wherein the group of data channels comprise at least a first data channel and a second data channel, and the first and second data channels are not coupled at all during a second inversion type of driving approach of the LCD device, or the first data channel is coupled to one or more third data channels during at least a partial time of the second inversion type of driving approach of the LCD device, wherein at least one of the one or more third data channels is different from the second data channel;

wherein each of a plurality of first charge sharing switches is individually coupled between two adjacent odd data channels of the plurality of data channels, each of a plurality of second charge sharing switches is individually coupled between two adjacent even data channels of the plurality of data channels, each of a plurality of third charge sharing switches is individually coupled between a node and each of the plurality of data channels, and wherein the control unit turns on the plurality of first charge sharing switches and second charge sharing switches and turns off the plurality of third charge sharing switches, to perform a first charge sharing on the adjacent odd data channels and the adjacent even data channels of the LCD device when the driving approach is a column inversion driving approach.

9. The driving device of claim 8, wherein the determining unit compares polarities of the polarity signals corresponding to two high voltage levels of the LD signal to determine the inversion type of the driving approach of the LCD device.

10. The driving device of claim 9, wherein the determining unit determines the inversion type of the driving approach of the LCD is the column inversion driving approach when the polarities of the polarity signal are the same.

11. The driving device of claim 10, wherein the control unit performs a first charge sharing on at least two adjacent odd channels of the LCD and at least two adjacent even channels of the LCD individually when the driving approach of the LCD is the column inversion driving approach.

12. The driving device of claim 9, wherein the determining unit determines the driving approach of the LCD is the dot inversion driving approach when the polarities of the polarity signal are different.

13. The driving device of claim 12, wherein the control unit performs a second charge sharing on at least two adjacent channels of the LCD when the driving approach of the LCD is the dot inversion driving approach.

14. The method of claim 8, wherein the driving approaches comprise the column inversion driving approach and a dot inversion driving approach.

15. A liquid crystal display (LCD) device comprising:

a display panel;

a timing controller for outputting a latch data (LD) signal and a polarity signal;

a charge sharing module coupled to the timing controller for detecting an inversion type of a driving approach of the LCD to output a control signal according to the LD signal and the polarity signal; and a source driver coupled to the display panel and the charge sharing module for outputting image data to the display panel and adjusting coupling relationship among a plurality of data channels to correct charge sharing on the plurality of data channels according to the control signal, wherein the charge sharing is performed on different groups of the data channels according to different inversion types of driving approaches of the LCD device;

wherein at least a group of data channels are coupled to perform charge sharing during at least a partial time of a first inversion type of driving approach of the LCD device, wherein the group of data channels comprise at least a first data channel and a second data channel, and the first and second data channels are not coupled at all during a second inversion type of driving approach of the LCD device, or the first data channel is coupled to one or more third data channels during at least a partial time of the second inversion type of driving approach of the LCD device, wherein at least one of the one or more third data channels is different from the second data channel;

wherein the charge sharing module compares polarities of the polarity signal corresponding to two adjacent high voltage levels of the LD signal, to determine the inversion type of the driving approach of the LCD and output the control signal;

wherein the source driver comprises:

a switch module for adjusting the coupling relationship among the plurality of data channels to correct the charge sharing performed on the plurality of data channels according to the control signal;

wherein the switch module comprises:

a plurality of first charge sharing switches, each of the plurality of first charge sharing switches individually coupled between two adjacent odd data channels of the plurality of data channels;

a plurality of second charge sharing switches, each of the plurality of second charge sharing switches individually coupled between two adjacent even data channels of the plurality of data channels; and a plurality of third charge sharing switches, each of the plurality of third charge sharing switches individually coupled between a node and each of the plurality of data channels;

wherein the switch module turns on the plurality of first charge sharing switches and second charge sharing switches and turns off the plurality of third charge sharing switches according to the control signal, to perform a first charge sharing on the adjacent odd data channels and the adjacent even data channels of the LCD device when the driving approach is a column inversion driving approach.

16. The LCD device of claim 15, wherein the charge sharing module determines the driving approach of the LCD is a column inversion driving approach and outputs the control signal when the polarities of the polarity signal are the same.

17. The LCD device of claim 15, wherein the charge sharing module determines the driving approach of the LCD is a dot inversion driving approach and outputs the control signal when the polarities of the polarity signal are different.

18. The LCD device of claim 17, wherein the charge sharing module comprises:

a determining device coupled to the timing controller for comparing the polarities of the polarity signal corresponding to the two adjacent high voltage levels of the LD signal; and a control unit coupled to the determining unit and the source driver for outputting the control signal according to a comparison result of the determining unit.

19. The LCD device of claim 15, wherein the switch module turns on the plurality of first charge sharing switches, second charge sharing switches and third charge sharing switches according to the control signal, to perform a second charge sharing on the adjacent data channels of the LCD device when the driving approach is the dot inversion driving approach.

20. The LCD device of claim 15, wherein the source driver is coupled to the adjacent odd channels and the adjacent even channels to perform a first charge sharing when the driving approach is the column inversion driving approach.

21. The LCD device of claim 15, wherein the source driver is coupled to the adjacent channels to perform a second charge sharing when the driving approach is the dot inversion driving approach.

22. The method of claim 15, wherein the driving approaches comprise the column inversion driving approach and a dot inversion driving approach.

23. A driving method for a liquid crystal display (LCD) device, the driving method comprising:

driving the LCD device by using a plurality of different inversion types of driving approaches at different times, wherein the different inversion types of driving approaches correspond to a charge sharing mechanism on different groups of data channels, respectively; and performing the charge sharing mechanism on different groups of data channels corresponding to the different inversion types of driving approaches respectively when the different inversion types of driving approaches are being used to drive the LCD device at the different times;

wherein at least a group of data channels are coupled to perform charge sharing during at least a partial time of a first inversion type of driving approach of the LCD device, wherein the group of data channels comprise at least a first data channel and a second data channel, and the first and second data channels are not coupled at all during a second inversion type of driving approach of the LCD device, or the first data channel is coupled to one or more third data channels during at least a partial time of the second inversion type of driving approach of the LCD device, wherein at least one of the one or more third data channels is different from the second data channel;

wherein the step of performing the charge sharing mechanism on different groups of data channels corresponding to the different inversion types of driving approaches respectively when the different inversion types of driving approaches are being used to drive the LCD device at the different times comprises:

individually coupling each of a plurality of first charge sharing switches between two adjacent odd data channels of the plurality of data channels;

individually coupling each of a plurality of second charge sharing switches between two adjacent even data channels of the plurality of data channels; and individually coupling each of a plurality of third charge sharing switches between a node and each of the plurality of data channels;

turning on the plurality of first charge sharing switches and second charge sharing switches and turns off the plurality of third charge sharing switches, to perform a first charge sharing on the adjacent odd data channels and the adjacent even data channels of the LCD device when the driving approach is a column inversion driving approach.

24. The method of claim 23, wherein the driving approaches comprise at least one of the column inversion driving approach and a dot inversion driving approach.

25. A source driver, comprising:

a plurality of data channels, for driving an LCD device by using a plurality of different inversion types of driving approaches at different times, wherein the different inversion types of driving approaches correspond to a charge sharing mechanism on different groups of data channels, respectively; and a plurality of switches, coupled to the data channels, for performing the charge sharing mechanisms, on different groups of data channels corresponding to the different inversion types of driving approaches respectively when the different inversion types of driving approaches are being used to drive the LCD device at the different times;

wherein at least a group of data channels are coupled to perform charge sharing during at least a partial time of a first inversion type of driving approach of the LCD device, wherein the group of data channels comprise at least a first data channel and a second data channel, and the first and second data channels are not coupled at all during a second inversion type of driving approach of the LCD device, or the first data channel is coupled to one or more third data channels during at least a partial time of the second inversion type of driving approach of the LCD device, wherein at least one of the one or more third data channels is different from the second data channel;

wherein the plurality of switches comprises:

a plurality of first charge sharing switches, each of the plurality of first charge sharing switches individually coupled between two adjacent odd data channels of the plurality of data channels;

a plurality of second charge sharing switches, each of the plurality of second charge sharing switches individually coupled between two adjacent even data channels of the plurality of data channels; and a plurality of third charge sharing switches, each of the plurality of third charge sharing switches individually coupled between a node and each of the plurality of data channels;

wherein the switch module turns on the plurality of first charge sharing switches and second charge sharing switches and turns off the plurality of third charge sharing switches, to perform a first charge sharing on the adjacent odd data channels and the adjacent even data channels of the LCD device when the driving approach is a column inversion driving approach.

* * * * *